US009174113B2

(12) United States Patent
Thompson

(10) Patent No.: US 9,174,113 B2
(45) Date of Patent: Nov. 3, 2015

(54) ADAPTIVE RAMP FOR ACCESSING AN ENCLOSED ICE SURFACE

(71) Applicant: Isaac John Thompson, Colorado Springs, CO (US)

(72) Inventor: Isaac John Thompson, Colorado Springs, CO (US)

( * ) Notice: Subject to any disclaimer, the term of this patent is extended or adjusted under 35 U.S.C. 154(b) by 0 days.

(21) Appl. No.: 14/181,877

(22) Filed: Feb. 17, 2014

(65) Prior Publication Data

US 2014/0237739 A1 Aug. 28, 2014

Related U.S. Application Data

(60) Provisional application No. 61/769,436, filed on Feb. 26, 2013.

(51) Int. Cl.

| | |
|---|---|
| ***A63C 19/10*** | (2006.01) |
| ***E01C 13/00*** | (2006.01) |
| ***E04F 11/00*** | (2006.01) |

(52) U.S. Cl.

CPC ..... *A63C 19/10* (2013.01); *E01C 13/003* (2013.01); *E04F 11/002* (2013.01); *A63C 2201/10* (2013.01); *E04F 2011/005* (2013.01)

(58) Field of Classification Search

CPC .... B65G 69/30; B65G 69/28; B65G 69/2811; A61G 1/013; E04F 2011/005; E04F 11/002; E04F 11/00

USPC ..... 14/2.4, 69.5

See application file for complete search history.

(56) References Cited

U.S. PATENT DOCUMENTS

| | | | | | |
|---|---|---|---|---|---|
| 426,209 | A * | 4/1890 | McIntyre | 14/69.5 |
| 4,285,514 | A * | 8/1981 | Romero | 472/89 |
| 4,864,672 | A * | 9/1989 | Altieri et al. | 14/69.5 |
| 5,544,861 | A * | 8/1996 | Wisner et al. | 254/88 |
| 5,933,898 | A * | 8/1999 | Estes et al. | 14/69.5 |
| 6,551,192 | B1 * | 4/2003 | Rieber et al. | 472/88 |
| 6,654,977 | B1 * | 12/2003 | Chin | 14/69.5 |
| 7,145,078 | B2 * | 12/2006 | Henry | 174/101 |
| 7,309,836 | B2 * | 12/2007 | Lubanski | 174/101 |
| 7,795,535 | B2 * | 9/2010 | Lubanski | 174/97 |
| 8,001,643 | B1 * | 8/2011 | James | 14/69.5 |
| 8,784,223 | B2 * | 7/2014 | Talafous | 472/90 |
| 2009/0020305 | A1 * | 1/2009 | Fidler | 174/50 |
| 2010/0050348 | A1 * | 3/2010 | Mapp | 14/69.5 |
| 2013/0133143 | A1 * | 5/2013 | Purdon | 14/69.5 |

* cited by examiner

*Primary Examiner* — Abigail A Risic
(74) *Attorney, Agent, or Firm* — Boyle Fredrickson, S.C.

(57) ABSTRACT

An ice access ramp assembly for accessing an ice surface includes a central bridge section and a pair of ramp sections. Each ramp section is pivotably mounted to the central bridge section for movement between a folded configuration and an extended configuration. The ramp sections and the central bridge section have surfaces formed of a low friction material. When the ramp assembly is extended, a first ramp section provides access from an outer floor and enables a sled skater to move up the first ramp section and onto the central bridge section. The sled skater can then move from the central bridge area onto the second ramp section, which provides access onto the ice surface. When not in use, the ramp assembly can be folded for storage and transport. The ramp assembly may include wheels that facilitate transport of the ice access ramp assembly over a floor or other surface.

5 Claims, 5 Drawing Sheets

ADAPTIVE RAMP FOR ACCESSING AN ENCLOSED ICE SURFACE

CROSS-REFERENCE

This application claims the benefit of U.S. Provisional Application Ser. No. 61/769,436, filed Feb. 26, 2013, the entirety of each of which is expressly incorporated by reference herein.

BACKGROUND OF THE INVENTION

1. Field of the Invention

This invention relates to the field of access devices, such as for use by disabled persons, and more particularly to a ramp for providing access to an enclosed ice surface.

2. Background

Sled skating and sled hockey are sports that enable certain persons to enjoy activities on ice that may not otherwise be possible. Sled skating involves a specially designed sled with skate blades under a seat. A person sits on the seat and uses short sticks with ice picks at one end to propel himself or herself across the ice. Sled skating is a noncontact activity that provides an excellent upper body workout to improve core muscles and trunk balance. Sled hockey can be played by sled skaters using the rules of hockey. For sled hockey, the sticks include blades, like the blade of a conventional hockey stick, to move the puck. Often, sled skating and sled hockey are activities enjoyed by persons who may not have full use of their legs, such as those with cerebral palsy, amputations, paraplegia, spina bifida, club feet, hip and knee problems, multiple sclerosis, etc.

Most standard enclosed ice areas or ice surfaces are not conducive for sled skaters because a raised area is located between the ice surface and the outer floor that surrounds it. Typically, the raised area is defined by a lower part of a door frame, which mounts a door that can be opened and closed to provide access to the ice surface. In the past, sled skaters have been moved onto the ice surface from the surrounding floor by one or more persons physically lifting the sled skaters off the floor, transporting them over the raised area and then lowering them onto the ice surface. Sled skaters can be any age and size, and it can readily be appreciated that moving larger sled skaters onto and oft the ice surface can be a daunting task.

What is therefore needed is an easy, convenient way to move sled skaters onto and off an ice surface over a raised area that surrounds the ice surface.

SUMMARY AND OBJECTS OF THE INVENTION

The present invention is designed to provide sled skaters with an easy convenient way to access an ice surface that includes a raised area or step adjacent the edge of the ice surface. In accordance with the present invention, an ice access ramp assembly for accessing an ice surface includes a central bridge section or area and a pair of ramp sections located one on either side of the central bridge area. Each ramp section is pivotably mounted at an inner end to the central bridge area such that the ramp sections can be moved between a folded configuration and an extended configuration. The ramp sections and the central bridge area have surfaces formed of a low friction material. When the ramp sections are in the extended configuration, a first one of the ramp sections provides access from an outer floor and enables a sled skater to be move up the first ramp section and onto the central bridge area. The sled skater can move from the central bridge area onto a second one of the ramp sections, which provides access onto the ice surface. Such movements are reversed when the sled skater wishes to move off the ice surface onto the surrounding floor. When not in use, the ramp sections can be placed in the folded configuration for storage and transport. The ramp sections may include wheels that facilitate transport of the ice access ramp assembly over a floor or other surface.

Various other features, objects and advantages of the present invention will be made apparent from the following description taken together with the drawings.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiment illustrated in the drawings accompanying and forming a part of this specification, wherein like reference numerals designate the same elements in the several views, and in which.

Figure 1:
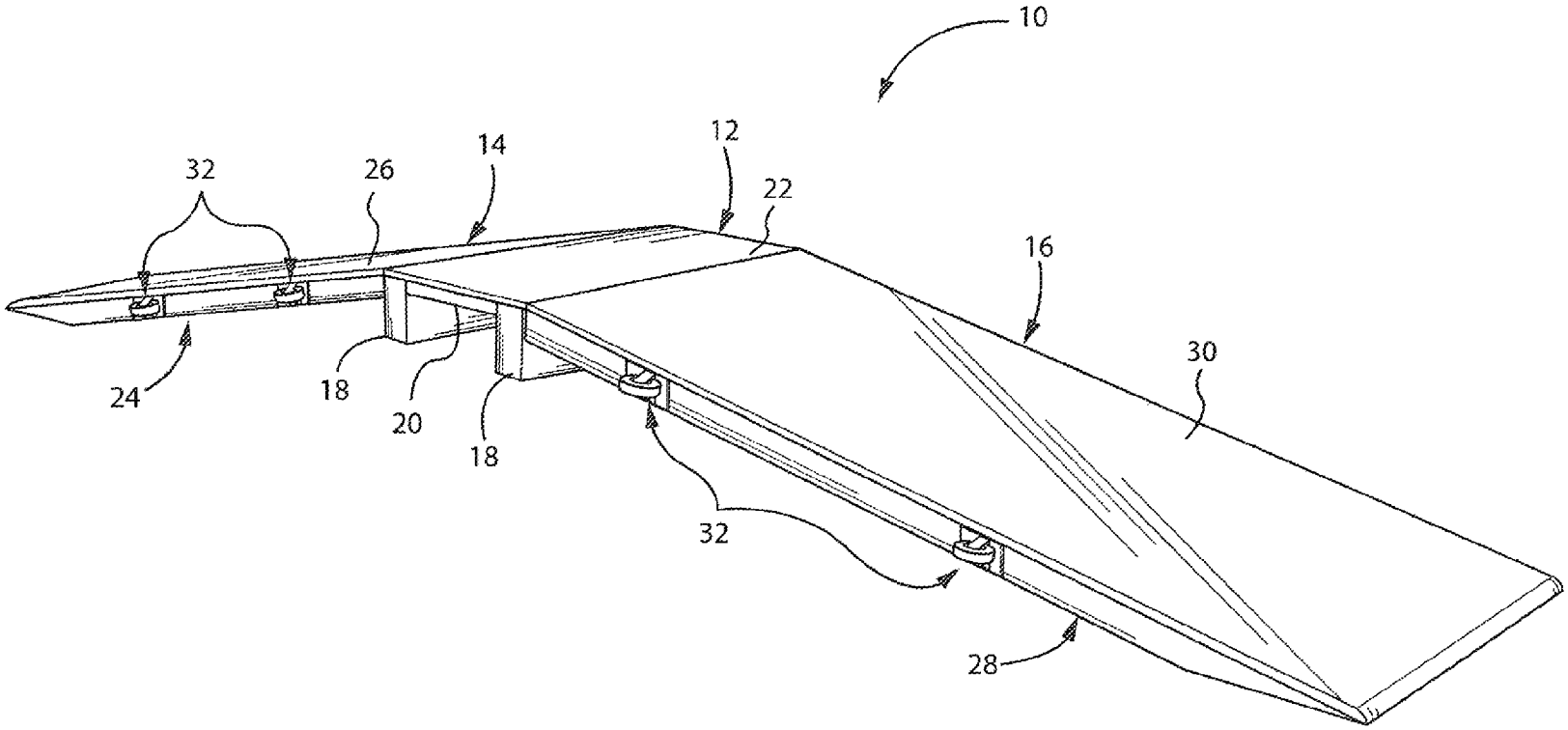
FIG. 1 illustrates an isometric view of an ice access ramp assembly according to the present invention, showing the ramp assembly in an extended, use configuration.

In describing the embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the words "connected", "attached", or terms similar thereto are often used. They are not limited to direct connection but include connection through other elements where such connection is recognized as being equivalent by those skilled in the art.

DETAILED DESCRIPTION

The present invention and the various features and advantageous details thereof are explained more fully with reference to the non-limiting embodiments described in detail in the following description.

Referring to FIG. 1, an ice access ramp assembly 10 in accordance with the present invention is illustrated in an extended, use position. Ice access ramp assembly 10 generally includes a central bridge section 12, a first ramp section 14 located on one side of the bridge section 12, and a second ramp section 16 located on the other side of bridge section 12.

In the illustrated embodiment, bridge section 12 includes a pair of spaced apart transverse upright frame members 18 and a series of upper frame members, such as shown at 20, that are located between transverse upright frame members 18. Bridge section 12 further includes an upper wall or panel 22 that overlies the frame members 18, 20.

First and second ramp sections 14, 16, respectively, have the same general construction. First ramp section 14 has a frame assembly 24 constructed of a series of interconnected frame members, along with an upper wall or panel 26 that overlies frame assembly 24. Similarly, second ramp section 16 has a frame assembly 28 constructed of a series of interconnected frame members, along with an upper wall or panel 30 that overlies frame assembly 28. The inner end of frame assembly 24 of first ramp section 14 is pivotably connected to bridge section 12 adjacent one of transverse upright frame members 18, such as via a conventional piano-type hinge assembly. Similarly, the inner end of frame assembly 28 of second ramp section 16 is pivotably connected to bridge section 12 adjacent the other of transverse upright frame members 18, such as via a conventional piano-type hinge assembly. The frame members at the outer ends of frame assemblies 24, 28 may be beveled so as to enable the outer ends of respective top panels 26, 32 to be close to the surface on which the outer ends of the respective ramp sections 14, 16 are supported.

The upper surface of panel 22 of bridge section 12, as well as the upper surfaces of panels 26, 30 of respective ramp sections 14, 16, are formed of a material having a low coefficient of friction. Representatively, the panels 22, 26 and 30 may be formed of a Lexan material or other such low friction material. Representative satisfactory materials for panels 22, 26 and 30, commonly known as synthetic ice, are available under the designations Easy Glide from coldproducts.com and Super Glide from syntheticiceusa.com, although it is understood that any other satisfactory low friction material may be employed.

Wheel assemblies or casters, shown at 32, are mounted to the outer frame members of frame assemblies 24, 28.

Figure 2:
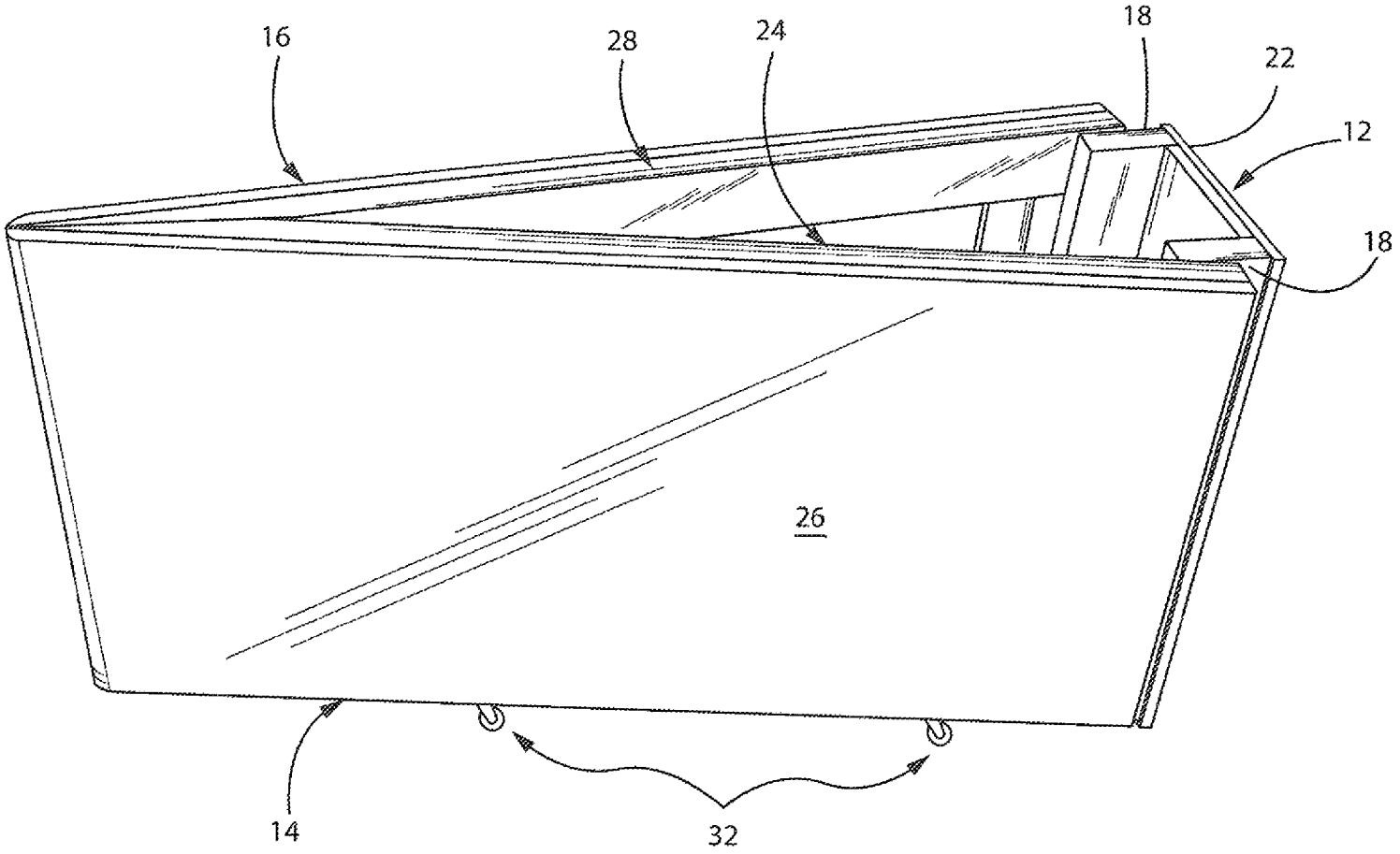
FIG. 2 illustrates an isometric view of the ice access ramp assembly of FIG. 1 in a folded, non-use configuration.
Figure 3:
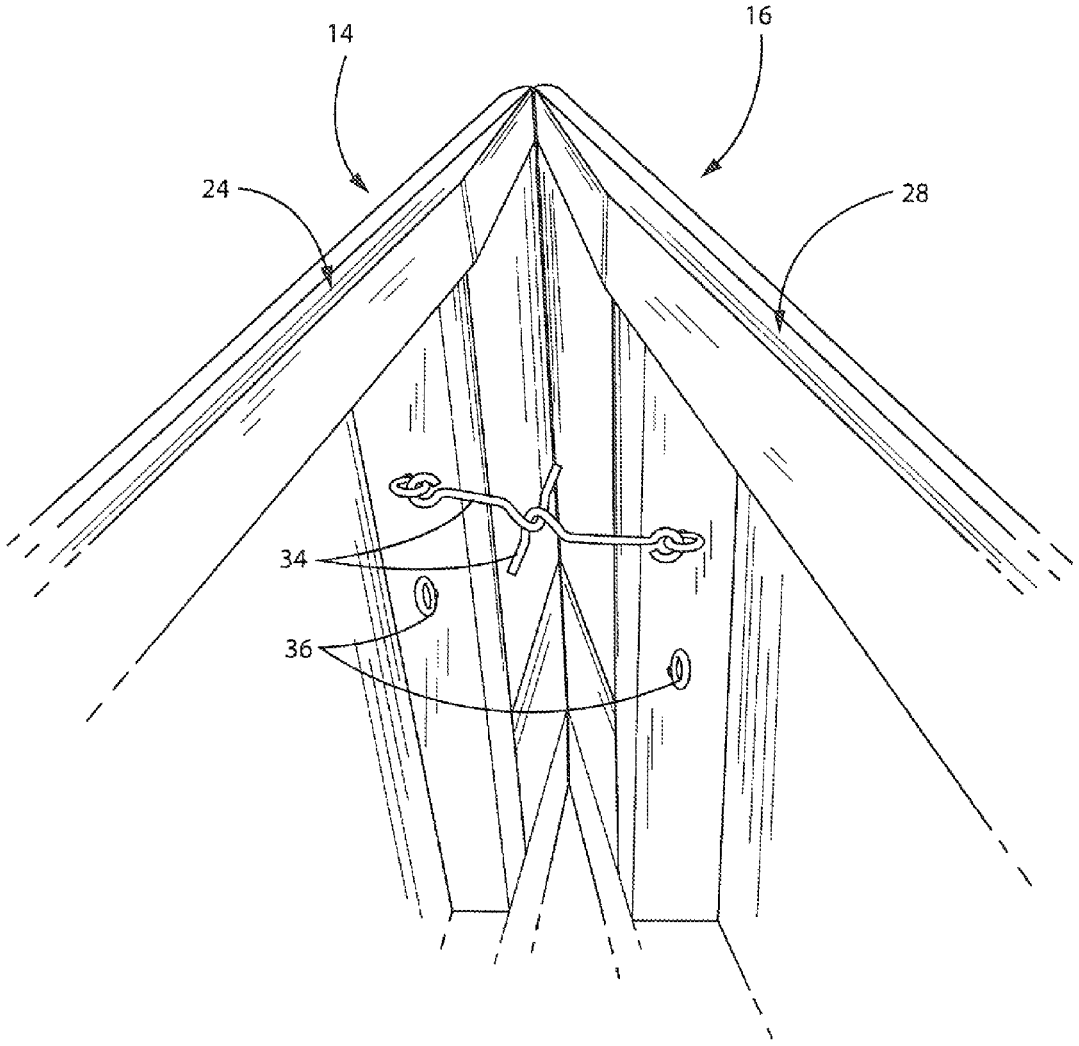
FIG. 3 illustrates a partial internal view of the ice access ramp assembly of FIG. 1 in the folded configuration.

FIG. 2 illustrates ice access ramp assembly 10 in a folded, non-use configuration such as for transport or storage. In this position, the first and second ramp sections 14, 16, respectively, are folded about their respective hinges at bridge section 12, and the outer ends of ramp sections 14, 16 are moved toward each other. The beveled outer ends of the frame members of frame assemblies 24, 28 enable the outer ends of the ramp sections 14, 16 to be moved close together. A retainer mechanism, such as shown in FIG. 3 as a pair of releasable hooks 34, may be employed to releasably maintain ice access ramp assembly 10 in the folded configuration. When not in use, the hooks 34 may be engaged with conventional eyes 36 secured to frame members of the frame assemblies 24, 28. Casters 32 facilitate movement of ice access ramp assembly 10 when in the folded, non-use configuration.

Figure 4:
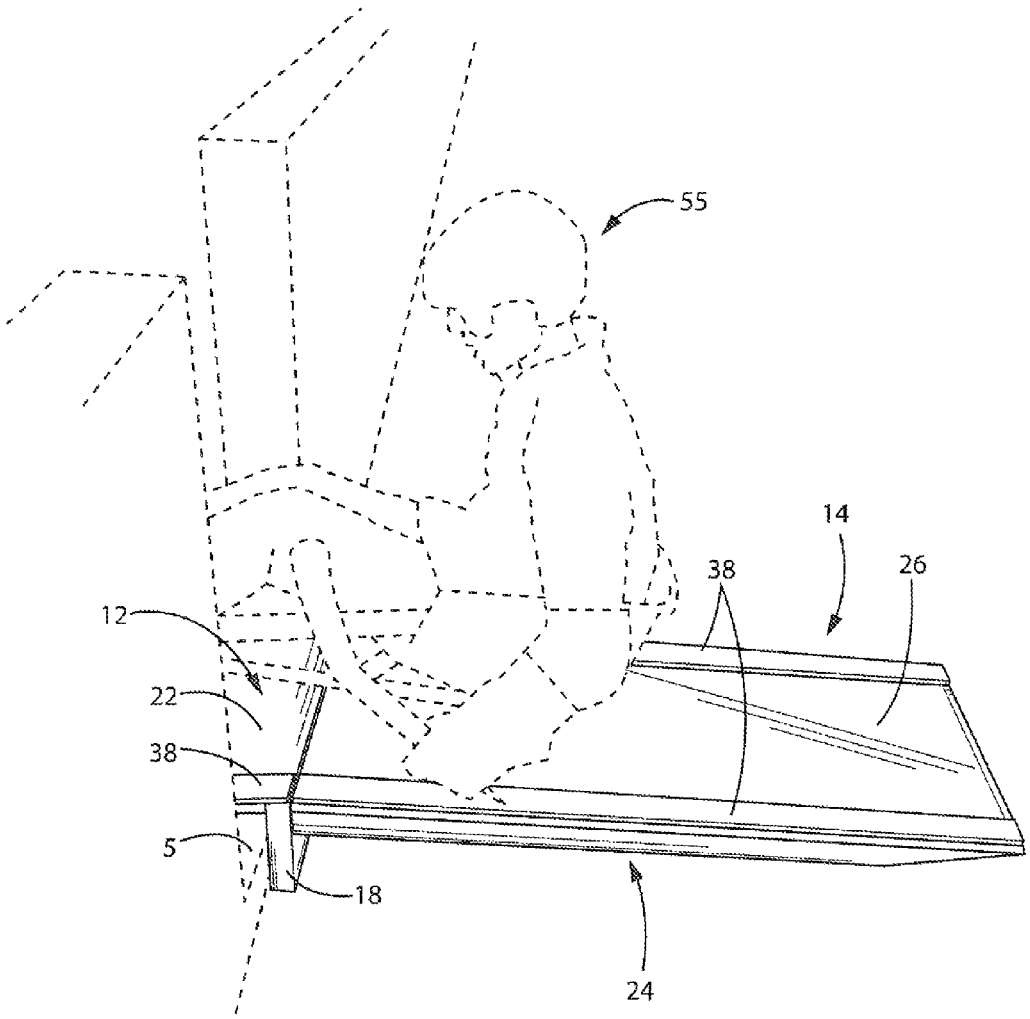
FIG. 4 illustrates a first view of the ice access ramp assembly of FIG. 1 in use.
Figure 5:
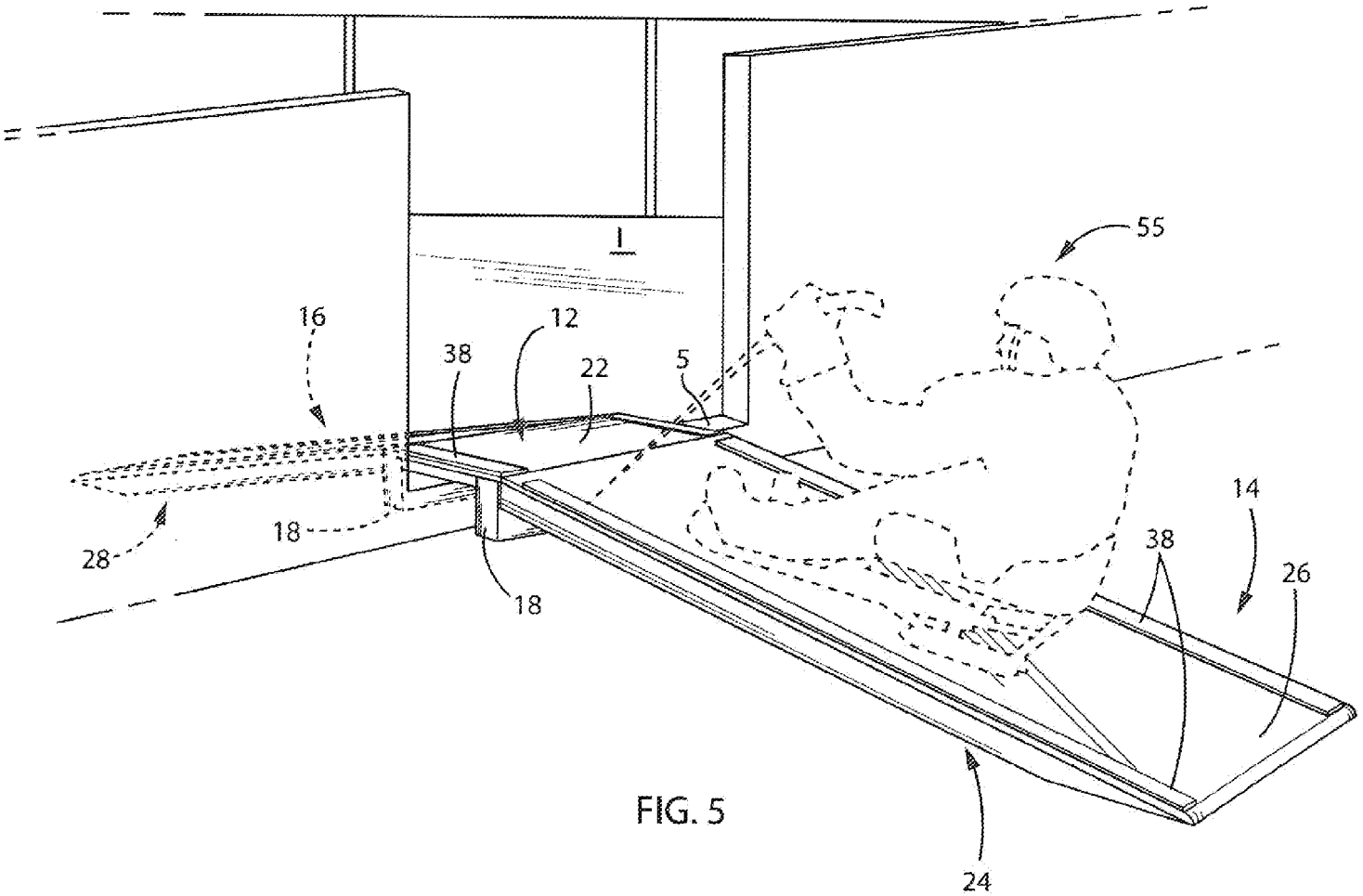
FIG. 5 illustrates a second view of the ice access ramp assembly of FIG. 1 in use.

FIGS. 4 and 5 illustrate the ice access ramp assembly 10 of the present invention in use, for facilitating movement of a sled skater, shown at SS, onto and off an ice surface I over a step S. In this application, ice access ramp assembly 10 is initially unfolded to its extended, use configuration and then positioned such that bridge section 12 overlies step S. In this position, ramp section 14 extends over the ice surface IS and its outer end is supported by the ice surface I. Similarly, the ramp section 16 extends over the floor outside the step S and the ice surface I, and its outer end is supported by the floor.

As shown in FIG. 4, the panels, such as 22, 26 and 30 are provided with gripper strips 38 at their outer edge areas. The gripper strips 38 are formed of a material that can be relatively easily penetrated by the picks at the ends of the sticks used by the sled skater SS. In this manner, the sled skater can approach the end of ramp section 14 under his or her own power, and then move the sled onto the upper surface of panel 26 over the slight rise at its end defined by the thickness of panel 26. Alternatively, to eliminate the slight rise, the end of panel 26 may be beveled. The sled skater SS can then use his or her own sticks to engage the strips 38 and move himself or herself up the ramp section 14 on the panel 26, onto the panel 22 of the bridge section 12, and then onto the panel 30 of the ramp section 16 for movement onto the surrounding floor. Alternatively, if desired, a helper or two may be positioned adjacent the ice access ramp assembly 10 to provide assistance to the sled skater SS along the ramp surfaces. When use of the ice access ramp assembly 10 is completed, it is lifted off the ice surface I, step S and surrounding floor and then folded for transport or storage.

It can thus be appreciated that the ice access ramp assembly of the present invention provides quick and easy movement of sled skaters from a floor onto an ice surface over a step that surrounds the ice surface. The ice access ramp assembly can be compactly folded for storage, and is easily moved from one location to another.

The individual components called out herein need not be fabricated from the disclosed materials, but could be fabricated from virtually any suitable materials. Moreover, the individual components need not be formed in the disclosed shapes, or assembled in the disclosed configuration, but could be provided in virtually any shape, and assembled in virtually any configuration. Further, although the components described herein are often described as physically separate modules, it will be manifest that they may be integrated into the apparatus with which it is associated. Finally, all the disclosed features of each disclosed embodiment can be combined with, or substituted for, the disclosed features of every other disclosed embodiment except where such features are mutually exclusive.

As can be seen, it is specifically intended that the present invention not be limited to the embodiments and illustrations contained herein, but includes modified forms of those embodiments, including portions of the embodiments and combinations of elements of different embodiments as come within the scope of the following claims.

What is claimed is:

1. A method of accessing an ice surface over a step from an outside surface, comprising the acts of:

providing a ramp assembly having a central bridge section, a first ramp arrangement having a first sled support surface and a second ramp arrangement having a second sled support surface, wherein the central bridge section includes a pair of spaced apart support members and an upper sled support surface extending therebetween, wherein the central bridge section defines a void area below the upper sled support surface and between the support members;

positioning the central bridge section over the step such that the step is received within the void area, wherein the pair of spaced apart support members are located one on either side of the step and the upper sled support surface of the central bridge section is located over the step;

placing the first ramp arrangement on a first side of the central bridge section on the outside surface and supporting the first ramp arrangement on the outside surface and on the central bridge section; and placing the second ramp arrangement on a second side of the central bridge section on the ice surface and supporting the second ramp arrangement on the ice surface and the central bridge section;

wherein, when the central bridge section is positioned over the step, the first ramp arrangement is positioned over and supported by the ice surface on the first side of the central bridge section, and the second ramp arrangement is positioned over and supported by a floor outside the step on the second side of the central bridge section, a sled skater advances a sled between the ice surface and the floor outside the step using the upper sled support surface of the central bridge section and the first and second sled support surfaces of the first and second ramp arrangements, respectively.

2. The method of claim 1, wherein the upper sled support surface of the central bridge section, the first sled support surface of the first ramp arrangement, and the second sled support surface of the second ramp arrangement have low friction surfaces.

3. The method of claim 2, wherein the first and second ramp arrangements are pivotably interconnected with the bridge section, and further comprising the acts of moving the first and second ramp arrangements between a folded configuration for storage and an extended configuration for use.

4. The method of claim 3, further comprising a wheel arrangement for facilitating movement of the ramp assembly when in the folded configuration, wherein the wheel arrangement is positioned on side edges defined by the first and second ramp arrangements.

5. The method of claim 2, further comprising penetrable strips at the edges of the central bridge section and the first and second ramp arrangements, wherein the penetrable strips are penetrated by pointed picks used by the sled skater to advance the sled skater on the first and second sled support surfaces of the first and second ramp arrangements, respectively and on the upper sled support surface of the central bridge section.

* * * * *